United States Patent [19]

Aschwanden et al.

[11] Patent Number: 4,699,063

[45] Date of Patent: Oct. 13, 1987

[54] EXPLOSIVE PRACTICE HAND GRENADE AND METHOD OF MANUFACTURE THEREOF

[75] Inventors: Paul Aschwanden; Robert Hodler, both of Schattdorf, Switzerland

[73] Assignee: Schweizerische Eidgenossenschaft vertreten durch die Eidg. Munitionsfabrik Altdorf der Gruppe für Rüstungsdienste, Altdorf, Switzerland

[21] Appl. No.: 695,521

[22] Filed: Jan. 28, 1985

[30] Foreign Application Priority Data

Feb. 2, 1984 [CH] Switzerland ..... 483/84

[51] Int. Cl.[4] ..... F42B 13/20; F42B 27/00; B65D 45/30

[52] U.S. Cl. ..... 102/498; 102/482; 292/256.6

[58] Field of Search ..... 102/498, 482, 489, 491, 102/496, 497, 529; 292/256.6, 256.63

[56] References Cited

U.S. PATENT DOCUMENTS

| | | | |
|---|---|---|---|
| 1,281,939 | 10/1918 | Gieda | 102/482 |
| 2,776,159 | 1/1957 | Cookson | 292/256.6 |
| 2,805,092 | 9/1957 | Herman | 292/256.63 |
| 3,156,188 | 11/1964 | Zernow et al. | 102/491 |
| 3,492,945 | 2/1970 | Filippi | 102/498 |
| 4,383,468 | 5/1983 | Sie et al. | 102/496 |

FOREIGN PATENT DOCUMENTS

| | | | |
|---|---|---|---|
| 0071722 | 2/1983 | European Pat. Off. . | |
| 1481762 | 4/1967 | France . | |
| 2269703 | 11/1975 | France . | |
| 7902833 | 10/1980 | Netherlands | 102/498 |

*Primary Examiner*—Deborah L. Kyle
*Assistant Examiner*—Michael J. Carone

[57] ABSTRACT

In an explosive practice hand grenade a ring containing inorganic particles is encased in a shell and substantially completely enclosed by an explosive charge. The ring is practically pulverized during detonation so that no effective fragments are formed. The ring is manufactured by compressing a metal or metal oxide powder. The inventive explosive practice hand grenade has substantially the same properties or characteristics as a combat-duty fragmentation hand grenade, however, has the advantage that the inventive explosive practice hand grenade, during its explosion, generates only a minimum fragment action and thus ensures the safety of personnel to be trained.

16 Claims, 4 Drawing Figures

EXPLOSIVE PRACTICE HAND GRENADE AND METHOD OF MANUFACTURE THEREOF

BACKGROUND OF THE INVENTION

The present invention relates to a new and improved construction of an explosive practice hand grenade and to a new and improved method of manufacturing such explosive practice hand grenade.

In its more particular aspects, the present invention relates specifically to a new and improved construction of an explosive practice hand grenade of high explosive pressure power and which comprises a shell, a body made of a high-explosive charge enclosed by the shell and defining an axis. A detonator including a delayed-action fuze is provided and arranged substantially in the axis defined by the body made of the high-explosive charge.

Explosive practice hand grenades for training purposes are known. Such hand grenades only approximately correspond to the conditions of combat practice with respect to their size, shape and the sound of the explosion. Particularly, the explosive practice hand grenades do not possess the properties or characteristics known for combat-duty fragmentation hand grenades. The weight, the position of the center of mass and the impact behavior after the throwing of the explosive practice hand grenade as well as the explosion pressure power, i.e. the explosive sound effect during the explosion, do not satisfy combat requirements. The known fragmentation hand grenades are also unsuited for training purposes due to the extraordinary danger caused by their fragments.

SUMMARY OF THE INVENTION

Therefore, with the foregoing in mind, it is a primary object of the present invention to provide a new and improved construction of an explosive practice hand grenade which meets the handling requirements and corresponds in function to a combat-duty fragmentation hand grenade without exposing the personnel to the danger caused by its fragments.

Now, in order to implement these and still further objects of the invention which will become more readily apparent as the description proceeds, the explosive practice hand grenade of the present development is manifested by the features that a ring or ring member is embedded in the explosive charge and is substantially completely enclosed by such explosive charge.

On detonating the inventive explosive practice hand grenade a large portion of the released energy is used for pulverizing and accelerating the particles of the aforementioned ring. The remaining energy firstly destroys the shell which is preferably formed by two interconnected hemispherical shells and then is released in the form of harmless clouds of smoke. Since the particles have a small size, such particles are very rapidly aerodynamically decelerated. The ring simultaneously serves as a balancing body.

Preferably the ring is composed of inorganic particles.

The particles, for example, may be compacted to form a compressed body which is decomposed into its components by the explosion. In this manner no effective fragments can occur at a distance of 5 m. Non-effective fragments are understood to represent fragments which are unable to pierce an aluminum sheet having a thickness of 2 mm and a tensile strength of 400 $N/mm^2$.

This effect is advantageously achieved due to the fact that the explosive charge approximately has a spherical shape define an explosive body having a body axis and the detonator is arranged approximately at the center of the spherical shape and along the body axis of the body of the explosive charge. A substantial portion of the explosive is thereby also arranged at the center of the ring and thus can uniformly act in a concentrated manner upon the ring due to the central detonation.

This effect is enhanced if the ring has preferably, and at least approximately, the shape of a hollow cylinder.

Advantageously, the height of the ring is selected such as to be substantially twice as great as its maximum wall thickness. A value of about 2:1 for the ratio of the height to the wall thickness results in manufacturing advantages, for example, during production of the molds required therefor.

In order to concentrate the largest possible proportion of the explosive charge in the interior of the ring, it is recommended to select the maximum spacing of the ring from the shell such that the spacing is substantially equal to the wall thickness of the ring.

When the outer substantially cylindrical shell of the ring is stepped, the attachment of a holding ring at approximately medium height of the ring is facilitated, which is of advantage for the assembly of the inventive explosive practice hand grenade.

The manufacture and assembly of the ring or ring member is additionally facilitated by providing the ring with bevelled peripheral edges.

Preferably, the powderous particles of the ring are selected from a particle size in the range of about 20 to 200 μm. For this purpose, a particle size distribution has been found favorable which contains a maximum of 35 percent of particles smaller than 63 μm and a maximum of 15 percent of particles which are greater than 160 μm.

It is particularly advantageous to produce the particles from sintering iron or steel. The sintering iron powder or steel can be economically manufactured and can be readily compacted when subjected to pressure. However, other metal powders or metal oxide powders can also be used for this purpose.

Preferably, the shell is formed by an upper substantially hemispherical shell and a lower substantially hemispherical shell. These hemispherical shells can be interconnected by welding as well as by bending-over or flanging or the like. Other known manners of interconnection can also be employed. It is recommendable therefore to select aluminum or an aluminum alloy as the material for the hemispherical shells. The sheet thickness of the substantially hemispherical shells is dimensioned such that no effective fragments are formed as a result of the explosion and amounts to values in the range of about 0.2 to about 2.0 mm, preferably about 0.5 to about 1 mm.

Advantageously, the holding ring is mounted on the inside between the connecting edges of the two substantially hemispherical shells. The holding ring primarily serves to essentially center the ring until such ring is fixed in its desired position by the explosive as it solidifies after casting.

Preferably, the holding ring is made of the same material as the substantially hemispherical shells which form the shell, i.e. of aluminum or of an aluminum alloy.

At its inner margin the holding ring preferably comprises recesses. These recesses serve as discharge openings for the air which escapes during the casting of the explosive as well as for enabling the explosive to continue to flow thereinto during casting.

As alluded to above, the invention is not only concerned with the aforementioned construction aspects, but also relates to a novel method of manufacturing the explosive practice hand grenade. Generally speaking, the inventive method is directed to manufacturing an explosive practice hand grenade containing a body of an high-explosive charge and a ring embedded in and substantially completely enclosed by said high-explosive charge.

To achieve the aforementioned measures, the inventive method, in its more specific aspects, comprises:

compressing powderous sintering iron or steel of a particle size in the range of, for example, about 20 μm to about 300 μm.

After a heat treatment by annealing with the addition of high molecular weight waxes in order to facilitate the compressing operation, the powderous sintering iron is compressed in a displaceable die at a pressure in the range of about 4,000 to about 8,000 bar, preferably at about 6,000 bar.

Preferably, the ring is phosphatized after the compressing operation.

Advantageously, the phosphatized ring is covered by a lacquer layer having a thickness in the range of about 20 to about 300 micrometers (μm); such lacquer layer is made of an explosive-compatible lacquer on the basis of acrylates.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
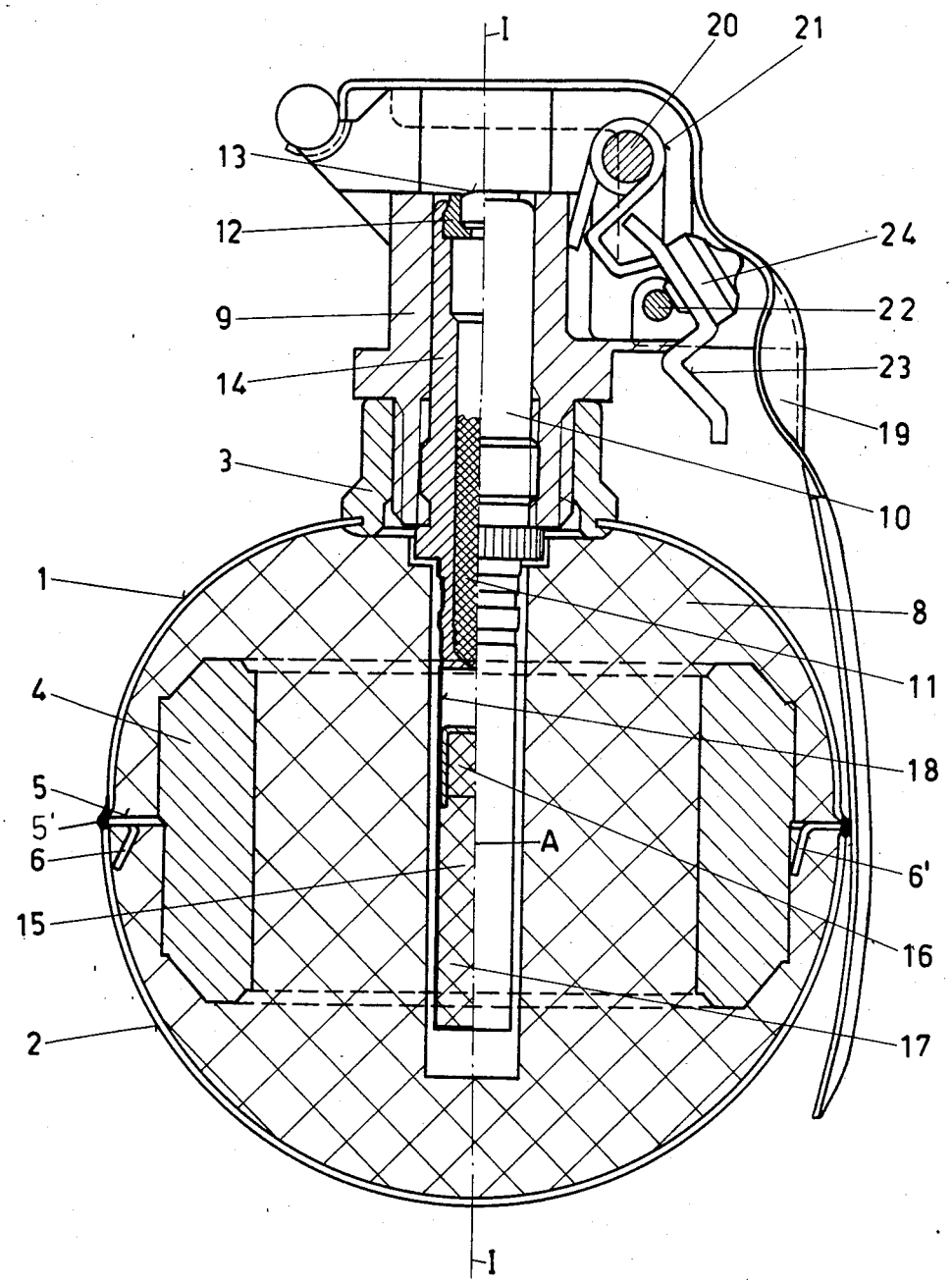
FIG. 1 is a longitudinal sectional view along an axis I—I of an exemplary embodiment of the inventive explosive practice hand grenade.

Describing now the drawings, it is to be understood that only enough of the construction of the explosive practice hand grenade has been shown as needed for those skilled in the art to readily understand the underlying principles and concepts of the present development, while simplifying the showing of the drawings. Turning attention now specifically to FIG. 1 of the drawings, there has been shown a longitudinal section of an exemplary embodiment of the inventive explosive practice hand grenade. The shell of the inventive explosive practice hand grenade possesses a central axis A and comprises an upper substantially hemispherical shell 1 and a lower substantially hemispherical shell 2 which are made of, for example, aluminum or an aluminum alloy. A threaded adapter 3 for receiving a fuze or detonator is provided in the upper substantially hemispherical shell 1. A ring or ring member 4 which is also called a disintegrating body, comprises a compressed body of powderous sintering iron or steel and is provided with a step or stepped portion 4'. As shown in FIG. 1 of the drawings the ring 4 is located about the central axis A of the practice hand grenade.

A holding ring 5 made of aluminum or an aluminum alloy engages the step or stepped portion 4'. This holding ring 5 is secured with its periphery between connecting edges 1' and 2' of the substantially hemispherical shells 1 and 2. The holding ring 5 is held at its inside against the inside of the lower hemispherical shell 2 by means of a clamp 6 and against the ring 4 by means of a further clamp 6'. It is the task of the holding ring 5 to insure the mounting and positioning of the ring 4 within the substantially hemispherical shells 1 and 2 prior to, and during, the casting of an explosive charge 8. The ring 4 which has an outer surface, an inner surface, a top surface and a bottom surface, is embedded in, and completely enclosed by, the explosive charge 8 which constitutes an active charge and each of these surfaces of the ring 4 is in contact with the explosive charge 8 as will be clearly evident by inspecting FIG. 1. Due to this arrangement, the application of the explosive is substantially concentrated at the inside of the ring 4. The region occupied by the explosive between the outside of the ring 4 and the inside of the substantially hemispherical shells 1 and 2 is dimensioned such that the shell can be disintegrated during the detonation only into ineffective fragments. A fuze or detonator head 9 is threaded into the threaded adapter 3. The left-hand side of a fuze or detonator element 10 is illustrated in a front-elevational view. A fuze or detonator cap 11, a fuze or detonator cap carrier 12 and a delay set 13 in a delay tube 14 are incorporated in an upper portion of the fuze or detonator element 10. In a lower portion of the fuze or detonator element 10, a sleeve 18 is inserted into an axial cut-out in the explosive charge 8 and accommodates a detonator or primer cap 15, an initiating explosive or primary charge 16 and an augmenting or secondary charge 17. A safety bracket 19 is attached to the fuze or detonator head 9 and carries by means of a pivot shaft or axle 20 a tension spring 21 which is secured by means of a safety split pin or splint 22. An impact device 23 carries an impact hammer 24.

Figure 2:
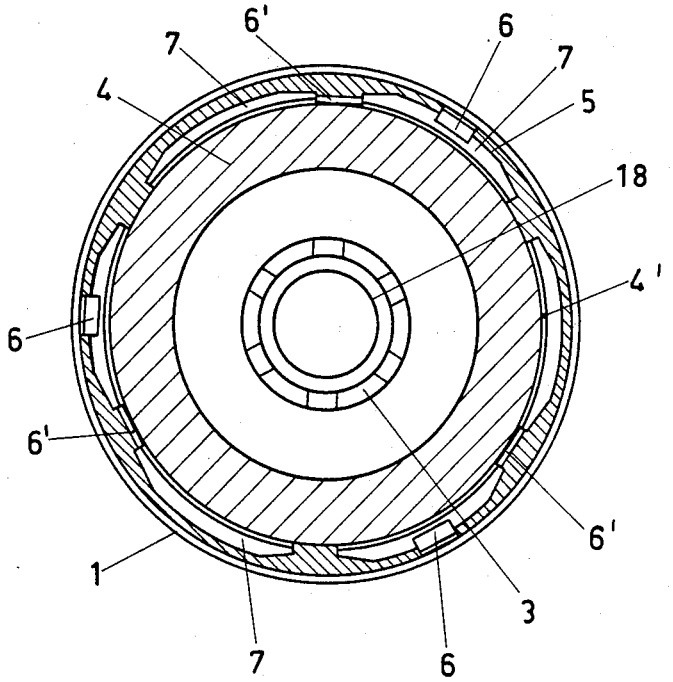
FIG. 2 is a cross-section through the explosive portion of the explosive practice hand grenade shown in FIG. 1 in the region of a holding ring of the explosive practice hand grenade.

FIG. 2 shows a cross-section in the region of the holding ring 5 through the explosive portion of the exemplary embodiment of the inventive explosive practice hand grenade illustrated in FIG. 1. In FIG. 2, a number of recesses 7 are shown in the holding ring 5 which ensure the escape of air from the lower substantially hemispherical shell 2 during the casting operation of the explosive charge 8 as well as during the follow-up flow of the explosive. For better clarity, the explosive between the ring 4 and the sleeve 18 as well as in the recesses 7 has not been illustrated by hatching as in FIG. 1. The holding ring 5 comprises protrusions on its inside which assume the shape of the clamp 6 and of the further clamp 6'. The clamps 6 serve to substantially center the holding ring 5 on the inside of the substantially hemispherical shells 1 and 2. The further clamps 6' on the inside of the holding ring 5 have a bending angle of more than 90° and are intended to readily yield due to their elasticity during assembly with the ring 4 such that they exert a clamping force. These further clamps 6' engage the substantially cylindrical surface of the holding ring 5 in such a manner that a return displacement of the holding ring 5 is prevented. The inner protrusions of the holding ring 5 are of such a length that they bear upon the step or stepped portion 4' of the ring or member 4.

Figure 3:
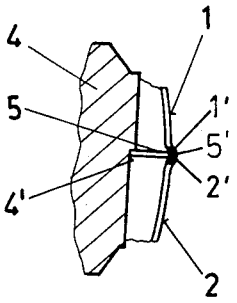
FIG. 3 is a cross-sectional view of a detail in the region of the mounting of the holding ring shown in FIG. 2.

FIG. 3 is a detailed cross-sectional view of the region between the upper substantially hemispherical shell 1 and the lower substantially hemispherical shell 2. The holding ring 5 is mounted within a groove of a weld seam 5'. As shown, a protrusion on the inside of the holding ring 5 engages the step or stepped portion 4' of the ring 4.

Figure 4:
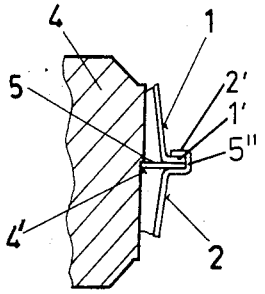
FIG. 4 is a cross-sectional view of a detail showing a variant of the mounting of the holding ring illustrated in FIG. 2.

A variant of the interconnection of the substantially hemispherical shells 1 and 2 is shown in FIG. 4 and assumes the shape of a bending-over or flanged or bordered interconnection 5'' at the rims of the two hemispherical shells 1 and 2. In this case, the holding ring 5 is secured within such bending-over or flanged interconnection.

The exemplary embodiment of the inventive explosive practice hand grenade fulfills the same function as a fragmentation hand grenade with respect to the outer shape, the size, the position of the center of mass, the nature of the outer surface, the weight as well as the impact behavior after throwing and the same explosive sound effect during explosion. However, the inventive explosive practice hand grenade has the decisive advantage that it generates only a minimum fragmenting power during explosion. This minimum fragmenting power is achieved due to the ring or ring member 4 which disintegrates into powder during the explosion.

While there are shown and described present preferred embodiments of the invention, it is to be distinctly understood that the invention is not limited thereto, but may be otherwise variously embodied and practiced within the scope of the following claims.

Accordingly, what we claim is:

1. An explosive practice hand grenade of high explosive pressure power and having a central axis, comprising:

a shell;

a body made of a high-explosive charge enclosed by said shell and defining a body axis;

a detonator including a delayed-action fuze and substantially arranged along said body axis defined by said body made of the high-explosive charge;

a ring containing an outer surface, an inner surface, a top surface and a bottom surface;

said ring being located about the central axis of the hand grenade and in contact with said high-explosive charge at said outer surface, said inner surface, said bottom surface and said top surface and being embedded in and substantially completely enclosed by said high-explosive charge.

2. The explosive practice hand grenade as defined in claim 1, wherein:

said ring contains inorganic particles.

3. The explosive practice hand grenade as defined in claim 1, wherein:

said high-explosive charge has a substantially spherical shape and defines a center; and said detonator being at least approximately located in the region of said center defined by said at least approximately spherical shape of said high-explosive charge.

4. The explosive practice hand grenade as defined in claim 1, wherein:

said ring at least approximately has the shape of a hollow cylinder.

5. The explosive practice hand grenade as defined in claim 1, further including:

a wall thickness defined by said ring;

an interior rim defined by said shell; and said ring being spaced from said interior rim defined by said shell by a maximum spacing which is substantially equal to said wall thickness of said ring.

6. The explosive practice hand grenade as defined in claim 1, wherein:

said ring defines bevelled peripheral edges.

7. The explosive practice hand grenade as defined in claim 1, wherein:

said ring located about said central axis of the hand grenade and embedded in and substantially completely enclosed by said high-explosive charge, constitutes a disintegratable body composed of particulate matter; and said disintegratable body disintegrating under the action of the detonation of the high-explosive charge in which the disintegratable body is embedded and substantially completely enclosed.

8. The explosive practice hand grenade as defined in claim 1, wherein:

said shell comprises an upper substantially hemispherical shell and a lower substantially hemispherical shell.

9. The explosive practice hand grenade as defined in claim 8, further including:

a holding ring;

said upper substantially hemispherical shell and said substantially lower hemispherical shell defining related connecting edges; and said holding ring being mounted between said connecting edges of said upper and lower substantially hemispherical shells.

10. The explosive practice hand grenade as defined in claim 9, wherein:

said holding ring is made of aluminum or an aluminum alloy.

11. The explosive practice hand grenade as defined in claim 13, further including:

an inner margin defined by said holding ring; and recesses formed at said inner margin defined by said holding ring.

a ring containing an outer surface, an inner surface, a top surface and a bottom surface;

said ring being located about the central axis of the hand grenade and in contact with said high-explosive charge at said outer surface, said inner surface, said bottom surface and said top surface and being embedded in and substantially completely enclosed by said high-explosive charge.

12. An explosive practice hand grenade of high explosive pressure power and having a central axis, comprising:

a shell;

a body made of a high-explosive charge enclosed by said shell and defining a body axis;

a detonator including a delayed-action fuze and substantially arranged along said body axis defined by said body made of the high-explosive charge;

a ring containing an outer surface, an inner surface, a top surface and a bottom surface;

said ring being located about the central axis of the hand grenade and in contact with said high-explosive charge at said outer surface, said inner surface, said bottom surface and said top surface and being embedded in and substantially completely enclosed by said high-explosive charge;

said ring possessing a predetermined height and a maximum wall thickness; and said height and said wall thickness of said ring being in a ratio of at least about 2:1.

13. An explosive practice hand grenade of high explosive pressure power and having a central axis, comprising:

a shell;

a body made of a high-explosive charge enclosed by said shell and defining a body axis;

a detonator including a delayed-action fuze and substantially arranged along said body axis defined by said body made of the high-explosive charge;

a ring containing an outer surface, an inner surface, a top surface and a bottom surface;

said ring being located about the central axis of the hand grenade and in contact with said high-explosive charge at said outer surface, said inner surface, said bottom surface and said top surface and being embedded in and substantially completely enclosed by said high-explosive charge;

said shell comprising two substantially hemispherical shells;

said ring having a stepped portion; and said stepped portion of said ring being located in the region of one of said two substantially hemispherical shells.

14. An explosive practice hand grenade of high explosive pressure power and having a central axis, comprising:

a shell;

a body made of a high-explosive charge enclosed by said shell and defining a body axis;

a detonator including a delayed-action fuze and substantially arranged along said body axis defined by said body made of the high-explosive charge;

a ring containing an outer surface, an inner surface, a top surface and a bottom surface;

said ring being located about the central axis of the hand grenade and in contact with said high-explosive charge at said outer surface, said inner surface, said bottom surface and said top surface and being embedded in and substantially completely enclosed by said high-explosive charge;

said ring containing inorganic particles; and said inorganic particles contained in said ring comprising powderous particles of a particle size in the range of about 20 to about 200 $\mu$m.

15. The explosive practice hand grenade as defined in claim 14, wherein:

said ring defines bevelled peripheral edges; and said inorganic particles comprise powderous sintering iron.

16. The explosive practice hand grenade as defined in claim 14, wherein:

said ring defines bevelled peripheral edges;

said inorganic particles comprise powderous sintering steel.

* * * * *